US006089320A

United States Patent [19]

LaGrange

[11] Patent Number: 6,089,320

[45] **Date of Patent: *Jul. 18, 2000**

[54] APPARATUS AND METHOD FOR LATERAL WELLBORE COMPLETION

[75] Inventor: Timothy Edward LaGrange, Edmonton, Canada

[73] Assignee: Halliburton Energy Services, Inc., Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/951,563

[22] Filed: Oct. 16, 1997

[51] Int. Cl.[7] ..... E21B 43/14

[52] U.S. Cl. ..... 166/313; 166/50; 166/117.5

[58] Field of Search ..... 166/117.5, 117.6, 166/313, 50, 52

[56] References Cited

U.S. PATENT DOCUMENTS

| | | | |
|---|---|---|---|
| 5,301,760 | 4/1994 | Graham . | |
| 5,318,121 | 6/1994 | Brockman et al. . | |
| 5,318,122 | 6/1994 | Murray et al. . | |
| 5,322,127 | 6/1994 | McNair et al. . | |
| 5,325,924 | 7/1994 | Bangert et al. . | |
| 5,353,876 | 10/1994 | Curington et al. . | |
| 5,388,648 | 2/1995 | Jordan, Jr. . | |
| 5,411,082 | 5/1995 | Kennedy . | |
| 5,435,392 | 7/1995 | Kennedy . | |
| 5,439,051 | 8/1995 | Kennedy et al. . | |
| 5,454,430 | 10/1995 | Kennedy et al. . | |
| 5,477,923 | 12/1995 | Jordan et al. . | |
| 5,520,252 | 5/1996 | McNair . | |
| 5,564,503 | 10/1996 | Longbottom et al. | 166/313 |
| 5,680,901 | 10/1997 | Gardes . | |
| 5,845,710 | 12/1998 | Longbottom et al. | 166/313 |

FOREIGN PATENT DOCUMENTS

| | | |
|---|---|---|
| 2282835 | 4/1995 | United Kingdom . |
| 2297779 | 8/1996 | United Kingdom . |
| WO97/06345 | 2/1997 | WIPO . |

OTHER PUBLICATIONS

Sperry–Sun Drilling Services, Inc., catalogue entitled "Horizontal Drilling: Multi–Lateral and Twinned Wells," 1993 (15 pages).

Sperry–Sun Drilling Services, Inc., catalogue entitled "Sourcebook," 1996, pp. 10–13 ("Drilling Services") and 57–62 ("Multilateral Drilling/Completion Systems").

Sperry–Sun Drilling Services, Inc., materials entitled "MSCS—Sperry–Sun's Multi–String Completion System," undated (5 pages).

Sperry–Sun Drilling Services, Inc., drawing entitled "LTBS—Lateral Tie–Back System," undated (1 page).

Sperry–Sun Drilling Services, Inc., drawing entitled "RMLS—Retrievable Multi–Lateral System," undated (1 page).

Sperry–Sun Drilling Services, Inc., materials entitled "Multilateral Case Studies," 1997 (4 pages).

*Primary Examiner*—William Neuder
*Attorney, Agent, or Firm*—Terrence N. Kuharchuk; Patrick H. McCollum; Eugene R. Montalvo

[57] ABSTRACT

An apparatus and method for completing a junction between a primary and secondary wellbore. A deflector is located in the primary wellbore adjacent to the wellbore junction. The apparatus comprises a conduit comprising: an upper section; a lower section comprising a primary leg for engaging a seat of the deflector and a secondary leg for insertion in the secondary wellbore; and a deformable conduit junction located between the upper and lower sections whereby the conduit is separated into the legs; such that when the apparatus is lowered in the primary wellbore, the secondary leg is deflected into the secondary wellbore by the deflector such that the conduit junction becomes deformed, and the primary leg then engages the seat.

28 Claims, 6 Drawing Sheets

APPARATUS AND METHOD FOR LATERAL WELLBORE COMPLETION

TECHNICAL FIELD

The present invention relates to an apparatus for insertion in a wellbore and a method for the purpose of completing the well, and specifically, for hanging a liner therein. More particularly, the invention relates to an apparatus and a method for completing a junction between a primary wellbore and a secondary or lateral wellbore, wherein the liner is hung within the secondary wellbore.

BACKGROUND OF THE INVENTION

Conventional technology provides for the drilling of a wellbore from the surface to a predetermined depth beneath the surface into a subterranean formation containing hydrocarbon reserves. Most conventional wellbores have traditionally been substantially vertical or perpendicular to the surface. However, current technology now provides for the drilling of deviated or non-vertical wellbores using directional drilling technology.

Directional drilling technology also allows for secondary, branch or lateral wellbores to be drilled laterally from a primary or main wellbore. A primary wellbore including more than one secondary or lateral wellbore is typically referred to as a multilateral well. Lateral wellbores are often drilled and produced through a gap in the casing of the primary wellbore. This gap typically comprises a window cut or milled in a section of the existing casing string. The lateral wellbore tends to extend laterally from the primary wellbore to a desired location within the formation.

As a result of the development of lateral wellbores, industry attention has more recently focused upon the difficulties associated with the completion of such wellbores. For instance, completion at the junction between the primary wellbore and the lateral wellbore is important in order to minimize any potential for the collapse of the well, as may occur in unconsolidated or weakly consolidated formations. The apparatus used for the completion of the junction between the primary and lateral wellbores preferably provides a means for hanging a conventional liner within the lateral wellbore, while hydraulically sealing the junction. As well, the apparatus used for completion preferably permits the diameter of the lined lateral wellbore to be as close as possible to the inner or drift diameter of the casing string of the primary wellbore in order to facilitate completion and servicing of the lateral wellbore and maximize production from the lateral wellbore.

U.S. Pat. No. 5,388,648 issued Feb. 14, 1995 relates to a number of methods and devices for completing lateral wells. Several of these methods and devices specifically relate to the completion and sealing of the junction between a vertical and lateral well. In particular, each of these methods and devices utilizes a "deformable means" to selectively seal the junction.

In one embodiment, the deformable means is comprised of an inflatable mold which includes an inner and outer bladder defining an expandable space therebetween for receiving a pressurized fluid. The mold must be comprised of a flexible plastic or rubber such that it is fully collapsible. The deformed or fully collapsed mold is run into the primary wellbore adjacent to the junction with the lateral wellbore. Pressure is then applied to cause the mold to take on a nodal shape having a laterally depending branch extending into the lateral wellbore. A slurry of hardenable or settable liquid (e.g. epoxy or cementitious slurry) is then pumped into the space between the mold and the wellbores to form a seal. In this manner, the hardenable liquid comprises a portion of the casing string of the wellbore. Thus, the mold is utilized during the setting and cementing of the casing string in the primary wellbore, and may not be particularly useful when the casing string is already formed in the primary wellbore.

In a further embodiment, the deformable means is comprised of an expandable memory metal device. The device includes a primary conduit section and a laterally extending branch. The lateral branch is made of a very specific material, being a shape memory alloy, which is fully deformed or collapsed during the insertion of the device into the primary wellbore. Once the device is positioned in the primary wellbore adjacent the junction with the lateral wellbore, heat is applied which causes the device to regain its original shape. As a result, the laterally extending branch extends into the lateral wellbore.

In a further embodiment, the deformable means is comprised of a swaging device for plastically deforming a sealing material. In particular, a liner is run through the primary wellbore and into the lateral wellbore. The liner includes a ranged element surrounding its periphery, which contacts the peripheral edges of the window in the casing string. A swage is then pulled through the primary wellbore, contacting the ranged element and forming a flange against the window of the casing. Thus, the ranged element is plastically deformed to form a seal at the junction.

In a final embodiment, the deformable means is comprised of a collapsible/expandable secondary string casing device, which device is run into the wellbore with the casing and forms part of the casing string. A window is milled into a length of a rigid primary casing body of the device. A collapsible/expandable secondary string casing, comprised of a special flexible alloy or a flexible plastic or rubber, is joined to the window in the primary casing body. The secondary string casing is collapsed to fit closely around the rigid primary casing body. and is run into position in the primary wellbore adjacent the junction with the lateral wellbore. Pressure is then applied to fully inflate the secondary string casing.

Each of these deformable means has inherent disadvantages in its use. For instance, a special flexible alloy, shape memory alloy or flexible plastic or rubber must be used to form all or a portion of the junction sealing device. Further, a portion of the device, typically the lateral branch or secondary string of the device, must be partially or fully deformable or collapsible in order to insert and place the device within the primary wellbore. As well, special swaging or pressure providing tools are often required to seal, inflate or expand the device within the primary wellbore. Typically, placement of the device requires plastic deformation of all or a portion of the device. Finally, the placement of the device may affect the setting and cementing of the casing string in the primary wellbore.

As a result, there remains a need in the industry for an improved apparatus and method for the completion of a wellbore, and in particular, for the completion of the junction between the primary and secondary or lateral wellbores. Preferably, the apparatus and method provide a means or manner of hanging a conventional liner within the secondary wellbore, while hydraulically sealing the junction between the primary and secondary wellbores. As well, the apparatus and method preferably allow a full bore drill out, in that the diameter of the completed secondary wellbore is about equal to the inner or drift diameter of the casing string in the primary wellbore.

SUMMARY OF THE INVENTION

The present invention relates to an apparatus for insertion in a wellbore and a method for the purpose of completing a well. More particularly, the invention relates to an apparatus and a method for the completion of the junction between a primary wellbore having an internal diameter and one or more secondary wellbores, each having an internal diameter. Preferably, the apparatus and method provide a means, device or method for hanging a conventional liner within the secondary wellbore, while hydraulically sealing the junction between the primary and secondary wellbores. As well, the apparatus and method for completion preferably allow a full bore drill out, in that the internal diameter of the completed secondary wellbore may be about equal to the internal or drift diameter of the casing string in the primary wellbore.

In a first aspect of the invention, the invention is comprised of an apparatus for insertion in a wellbore for the purpose of completing a well, the wellbore being of the type comprising a primary wellbore, a secondary wellbore intersecting the primary wellbore, a wellbore junction at the location of the intersection between the primary wellbore and the secondary wellbore, and a primary wellbore deflector located in the primary wellbore adjacent to the wellbore junction such that equipment inserted in the primary wellbore can be deflected into the secondary wellbore at the wellbore junction, the primary wellbore deflector comprising a seat for engagement with the apparatus, the apparatus comprising a conduit comprising the following:

(a) an upper section for attachment to a pipe string;

(b) a lower section comprising a primary leg for engaging the seat of the primary wellbore deflector and a secondary leg for insertion in the secondary wellbore; and (c) a deformable conduit junction located between the upper section and the lower section of the conduit whereby the conduit is separated into the primary leg and the secondary leg;

such that when the apparatus is connected to the pipe string and lowered in the primary wellbore, the secondary leg is deflected into the secondary wellbore by the primary wellbore deflector such that the deformable conduit junction becomes deformed, and the primary leg then engages the seat of the primary wellbore deflector.

In a second aspect of the invention, the invention is comprised of a method for hanging a liner in a wellbore, the wellbore being of the type comprising a primary wellbore, a secondary wellbore intersecting the primary wellbore, a wellbore junction at the location of the intersection between the primary wellbore and the secondary wellbore, and a primary wellbore deflector located in the primary wellbore adjacent to the wellbore junction such that when the liner is inserted in the primary wellbore it can be deflected into the secondary wellbore at the wellbore junction, the primary wellbore deflector comprising a seat, the method comprising the following steps in the sequence set forth;

(a) installing the primary wellbore deflector in the primary wellbore adjacent to the wellbore junction;

(b) lowering the liner into the wellbore, wherein the liner is attached to a secondary leg of a conduit which further comprises a primary leg for engagement with the seat of the primary wellbore deflector and a deformable conduit junction connecting the primary leg and the secondary leg;

(c) deflecting the liner into the secondary wellbore by the primary wellbore deflector;

(d) landing the liner into position by continuing to lower the liner into the wellbore so that the secondary leg of the conduit is deflected into the secondary wellbore by the primary wellbore deflector, the deformable conduit junction is deformed and the primary leg of the conduit engages the seat of the primary wellbore deflector.

The primary wellbore deflector may be comprised of any conventional deflector, such as a whipstock, capable of deflecting equipment from the primary wellbore into the secondary wellbore and comprising a seat capable of engaging the apparatus. However, preferably, the primary wellbore deflector further comprises a deflector conduit associated with the seat and the primary leg is capable of engaging the seat to facilitate the movement of fluids in the primary wellbore through the primary wellbore deflector and through the conduit. Further, although the primary leg may engage the seat in any manner facilitating the movement of the fluids in the primary wellbore, the primary leg preferably engages the seat in a manner to provide a sealed connection between the deflector conduit and the primary leg. In the preferred embodiment, the apparatus is further comprised of the primary wellbore deflector.

The primary leg preferably permits fluid to be conducted therethrough. Thus, the primary leg is preferably hollow or tubular. However, the primary leg need not be hollow where the conducting of fluid therethrough is neither required nor desired. In addition, the primary leg preferably comprises a guide for guiding the primary leg into engagement with the seat of the primary wellbore deflector. The guide may be positioned at any location along the length of the primary leg which permits the guide to perform its function. However, in the preferred embodiment, the primary leg has a distal end opposing the deformable conduit junction and the guide is located at, adjacent or in proximity to the distal end. The guide may be of any type, shape or configuration capable of guiding the primary leg.

The secondary leg also has a distal end opposing the deformable conduit junction. Further, the secondary leg preferably comprises an expansion section located at, adjacent or in proximity to the distal end. The expansion section preferably comprises a cross-sectional expansion of the secondary leg in order to increase its cross-sectional area. The expansion section may be of any type and have any size, shape and configuration permitting it to be lowered in the primary wellbore when the conduit junction is undeformed and permitting it to be deflected into the secondary wellbore upon deformation of the conduit junction. The expansion section has a maximum outside diameter, which is less than the internal diameter of the secondary wellbore.

Preferably, the primary leg and the secondary leg are substantially parallel to each other when the deformable conduit junction is undeformed. In addition, the secondary leg is preferably comprised of a semi-rigid material such that it comprises substantially the same cross-sectional dimension when the deformable conduit junction is both undeformed and deformed. Similarly, the primary leg is also preferably comprised of a semi-rigid material such that it comprises substantially the same cross-sectional dimension when the deformable conduit junction is both undeformed and deformed.

Any semi-rigid material may be used. For instance, the semi-rigid material comprising the primary and secondary legs may permit either plastic or elastic deformation. However, in the preferred embodiment, the semi-rigid material is selected or chosen such that the legs undergo elastic deformation upon the positioning and landing of the apparatus in the wellbores. In the preferred embodiment, the conduit, including the primary and secondary legs, is comprised of a steel alloy.

The deformable conduit junction may have any shape or configuration, and may connect the upper and lower sections of the conduit in any manner, which permits fluids to pass through the conduit and which separates the lower section into the primary and secondary legs. However, in the preferred embodiment, the deformable conduit junction is comprised of a welded connection between the primary leg and the secondary leg. Further, as described, the deformable conduit junction may be either in an undeformed position, for lowering of the conduit in the primary wellbore, or in a deformed position, upon deflection of the secondary leg and seating of the primary leg. Preferably, the deformable conduit junction is biased towards the undeformed position. However, alternately, the deformable conduit junction may be biased towards the deformed position. In addition, the conduit has a maximum outside diameter which is less than the internal diameter of the primary wellbore when the deformable conduit junction is undeformed.

The apparatus may further comprise a liner for lining the secondary wellbore. The liner, in the apparatus and the method, has a proximal end attached to the secondary leg of the conduit and a distal end. Any conventional liner for lining the secondary wellbore, including a perforated liner, a slotted liner or a prepacked liner, may be used. In addition, any conventional technique, device or method may be used to attach the proximal end to the secondary leg, such as by a threaded connection or welding. In the preferred embodiment, the proximal end is attached to the distal end of the secondary leg.

The distal end extends into the secondary wellbore and may be sealed in any conventional manner. In the preferred embodiment, the apparatus further comprises a conventional cap, such as a bullnose, attached to the distal end of the liner for sealing and guiding the distal end. The cap may be attached or connected by any conventional technique, device or method, such as by a threaded connection or welding.

The upper section of the conduit preferably comprises a proximal end opposing the deformable wellbore junction. In the preferred embodiment, a fluid cannot enter or exit the conduit except through the proximal end of the upper section and the distal ends of the primary and secondary legs of the conduit.

As well, the apparatus preferably further comprises a seal assembly associated with the upper section of the conduit, for providing a seal between the conduit and the primary wellbore. The seal assembly is preferably located at, adjacent or in proximity to the proximal end of the upper section. Further, the seal assembly may be comprised of any conventional seal or sealing structure. For instance, the seal assembly may be comprised of one or a combination of seals, packers, slips, liners or cementing.

Further, the apparatus preferably further comprises an anchor assembly associated with the upper section of the conduit for supporting the apparatus in the wellbore. The anchor assembly is preferably located at, adjacent or in proximity to the proximal end of the upper section. However, the anchor assembly may be located at any other suitable location for anchoring the apparatus. The anchor assembly may be comprised of any conventional anchor or anchoring structure, such as a liner hanger.

The apparatus of the within invention is preferably removable from the wellbore. Where the apparatus is also comprised of the primary wellbore deflector, the primary wellbore deflector is also preferably removable from the wellbore. The apparatus, including the primary wellbore deflector, may be removed by any conventional apparatus or technique for removing such equipment from a wellbore.

In the method of the within invention, the method may be performed using any suitable device or apparatus capable of being used to perform the particular method steps set out herein. However, preferably, the method is performed using the apparatus of the within invention.

The method may further comprise the step, following the landing step, of anchoring the liner in its landed position to the primary wellbore. The liner may be anchored to the primary wellbore using any conventional anchoring equipment, techniques or methods. However, in the preferred embodiment, the anchoring step comprises actuating an anchor assembly connected to the conduit.

In addition, the method may further comprise the step, following the lowering step, of orienting the liner for entry into the secondary wellbore. The method may also comprise the step, prior to the landing step, of orienting the conduit relative to the primary wellbore deflector such that the secondary leg is deflected into the secondary wellbore by the primary wellbore deflector and the primary leg engages the seat of the primary wellbore deflector. Any conventional orienting techniques or equipment may be used, such as an orienting latch assembly.

Finally, the method of the within invention is preferably further comprised of the step of removing the conduit from the primary and secondary wellbores following the landing step. As well, the method may be comprised of the step of removing the primary wellbore deflector from the primary wellbore following the removal of the conduit from the wellbores.

BRIEF DESCRIPTION OF DRAWINGS

Embodiments of the invention will now be described with reference to the accompanying drawings, in which.

DESCRIPTION OF INVENTION

The present invention is directed at an apparatus (20) and a method for completing a wellbore in a well, and in particular, for hanging a conventional liner in the wellbore. In particular, referring to FIG. 1, the wellbore is of the type comprising a primary wellbore (22) and at least one secondary wellbore (24). The primary wellbore (22) has an internal surface (26), and is generally circular in cross-section, such that the internal surface (26) of the primary wellbore (22) defines an internal diameter, referred to as the drift diameter. The primary wellbore (22) is preferably drilled from the surface to a predetermined or desired depth beneath the surface using known drilling technology. More particularly, the primary wellbore (22) is preferably comprised of a substantially vertical wellbore such that the longitudinal axis of the wellbore (22) is substantially perpendicular to the ground surface. However, the primary wellbore (22) may be a deviated wellbore such that its longitudinal axis is not substantially perpendicular to the ground surface. Further, the primary wellbore (22) may not extend directly to the surface, but may be comprised of a lateral or horizontal wellbore which intersects and is in communication with a further vertical or deviated wellbore which then extends to the surface for production of the well.

Figure 1:
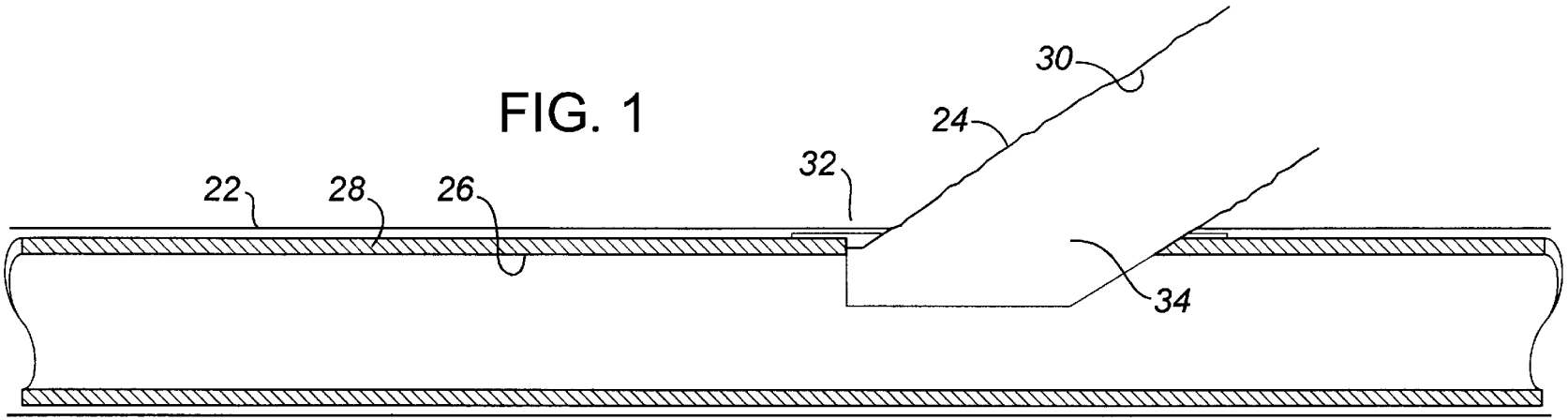
FIG. 1 is a longitudinal sectional view of a junction of a primary wellbore and a secondary wellbore, wherein the primary wellbore contains a casing string defining a lateral window or drill out.

The primary wellbore (22) may be left open hole or lined in any suitable, known manner to prevent collapse of the wellbore (22). However, preferably, the primary wellbore (22) is cased such that the primary wellbore (22) contains a casing string (28), as shown in FIG. 1. The casing string (28) is formed within the primary wellbore (22) using conventional casing techniques. Where the primary wellbore (22) contains the casing string (28), the internal diameter of the primary wellbore (22) is defined by the internal diameter of the casing string (28).

The secondary wellbore (24) also has an internal surface (30) and is generally circular on cross-section such that the internal surface (30) of the secondary wellbore (24) defines an internal diameter of the secondary wellbore (24). The secondary wellbore (24) intersects with the primary wellbore (22). In other words, the longitudinal axis of the primary wellbore (22) intersects with the longitudinal axis of the secondary wellbore (24). The location of the intersection between the primary and secondary wellbores (22, 24) defines a wellbore junction (32). The wellbore junction (32) permits communication between the wellbores (22, 24) such that drilling and other equipment may be passed from the primary wellbore (22) into the secondary wellbore (24) and such that fluids may be produced therethrough.

Although in the preferred embodiment of the within invention the well to be completed is comprised of only one secondary wellbore (24), the invention may also be used where the well is comprised of two or more secondary wellbores (24) intersecting with the primary wellbore (22). In this case, apparatus (20) and the method will be applied in succession to each of the wellbore junctions (32) commencing with the most distal wellbore junction (32) and working back towards the surface.

The secondary wellbore (24) is drilled using known drilling technology such that it extends laterally from the primary wellbore (22), at any desired angle or orientation to the primary wellbore (22), for a predetermined or desired distance. Preferably, the secondary wellbore (24) extends into a subterranean formation containing hydrocarbon reserves for production to the surface. The secondary wellbore (24) may also be left open hole or lined in any suitable, known manner to prevent collapse of the wellbore (24). Where the secondary wellbore (24) is lined or cased, the internal diameter of the secondary wellbore (24) is defined by the internal diameter of the liner or casing.

The wellbore junction (32) may be formed in any conventional manner using known techniques. For instance, the secondary wellbore (24) may be drilled and produced through a gap in the casing string (28) of the primary wellbore (22). This gap may be comprised of a window (34) cut or milled in a section or area of the casing string (28).

Referring to FIGS. 2 through 5, a primary wellbore deflector (36) is positioned or located adjacent to the wellbore junction (32). In particular, the primary wellbore deflector (36) is located distally to the wellbore junction (32), adjacent or in close proximity to it, such that when equipment is inserted through the primary wellbore (22), the equipment can be deflected into the secondary wellbore (24) at the wellbore junction (32) as a result of contact with the primary wellbore deflector (36). The primary wellbore deflector (36) may be anchored, installed or maintained in position within the primary wellbore (22) using any suitable conventional apparatus, device or technique. Although the primary wellbore deflector (36) may be permanently anchored or installed in the primary wellbore (22), the primary wellbore deflector (36) is preferably removably installed in the primary wellbore (22) such that it may be removed when no longer desired or required.

Figure 3:
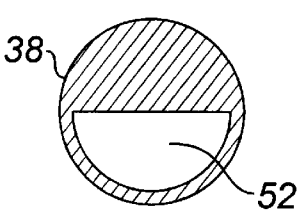
FIGS. 3 and 4 are cross-sectional views of the primary wellbore deflector taken along lines 3—3 and 4—4 respectively of FIG. 2.
Figure 4:
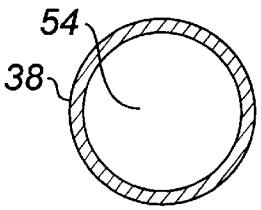

The primary wellbore deflector (36) has an external surface (38), an upper end (40) and a lower end (42). The external surface (38) of the deflector (36) may have any shape or configuration so long as the deflector (36) may be inserted in the primary wellbore (22) in the manner described herein. However, the external surface (38) of the deflector (36) is preferably substantially tubular or cylindrical such that the deflector (36) is generally circular on cross-section, as shown in FIGS. 3 and 4. Where the deflector (36) is cylindrical, the deflector (36) defines an external diameter. Where the deflector (36) is not cylindrical, the external diameter of the deflector (36) is defined by the maximum cross-sectional dimension of the deflector (36). In any event, as stated, the maximum external diameter of the deflector (36) is less than the internal diameter of the primary wellbore (22) so that the deflector (36) may be inserted in the primary wellbore (22).

The deflector (36) may have any external diameter less than the described maximum external diameter. However, preferably, the external diameter of the deflector (36) is about equal to the internal diameter of the primary wellbore (22) while still allowing the deflector (36) to be inserted in the primary wellbore (22). Thus, the external diameter of the deflector (36) is slightly or marginally less than the internal diameter of the primary wellbore (22). As a result, in the preferred embodiment, the external surface (38) of the deflector (36) will be adjacent or in close proximity to the internal surface of the casing string (28) when the deflector (36) is positioned in the primary wellbore (22).

In the preferred embodiment, the primary wellbore deflector is further comprised of a seal assembly (44). The seal assembly is associated with the external surface (38) of the deflector (36) such that the seal assembly (44) provides a seal between the external surface (38) of the deflector (36) and the internal surface (26) of the primary wellbore (22). Thus, wellbore fluids are inhibited from passing between the deflector (36) and the casing string (28). Preferably, the seal assembly (44) is comprised of any conventional seal or sealing structure and is located at, adjacent or in proximity to the lower end (42) of the deflector (36). For instance, the seal assembly (44) may be comprised of one or a combination of seals, packers, slips, liners or cementing.

Figure 2:
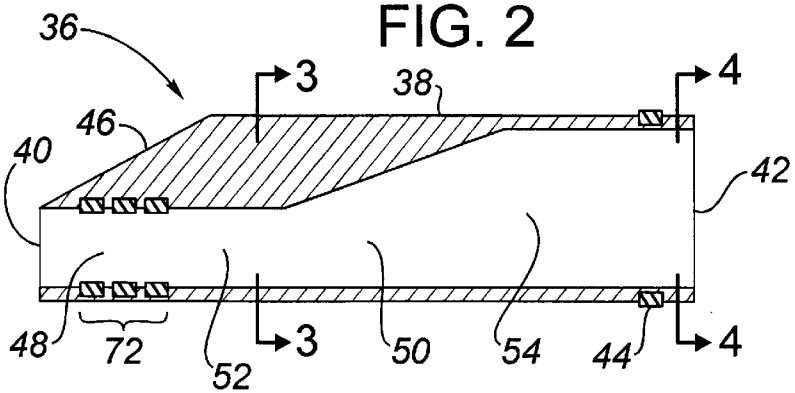
FIG. 2 is a longitudinal sectional view of a preferred embodiment of a primary wellbore deflector utilized in the within invention.
Figure 5:
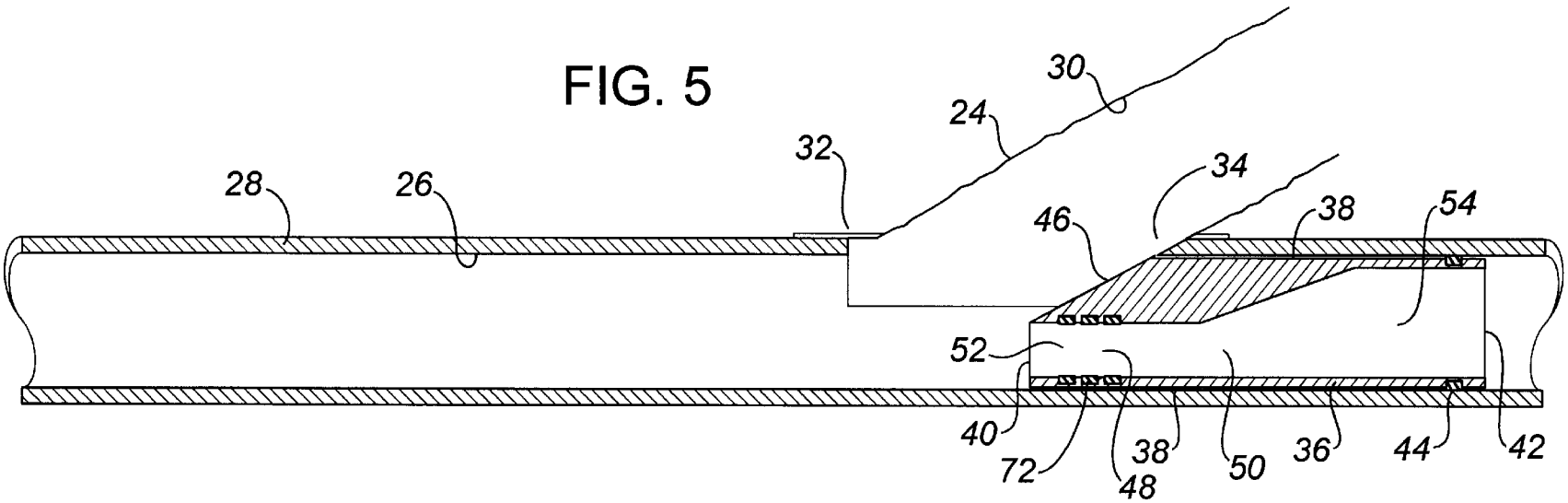
FIG. 5 is a longitudinal sectional view of the primary wellbore deflector of FIG. 2, wherein the primary wellbore deflector is set in a preferred position within the casing string of the primary wellbore, as shown in FIG. 1.

The primary wellbore deflector (36) further comprises a deflecting surface (46) located at the upper end (40) of the deflector (36) and a seat (48) for engagement with the apparatus (20). Any conventional deflector (36), such as a whipstock, having a deflecting surface (46) and a seat (48), may be used with the within invention. In the preferred embodiment, as shown in FIG. 3, the deflecting surface (46) is offset to one side adjacent the external surface (38). When positioned in the primary wellbore (22), as shown in FIG. 2, the deflecting surface (46) is located adjacent the secondary wellbore (24) such that equipment inserted through the primary wellbore (22) may be deflected into the secondary wellbore (24). The deflecting surface (46) may have any shape and dimensions suitable for performing this function, however, in the preferred embodiment, the deflecting surface (46) provides a sloped surface which slopes from the upper end (40) of the deflector (36) downwards, towards the lower end (42) of the deflector (36), and outwards, towards the external surface (38) of the deflector (36).

The seat (48) of the deflector (36) may also have any suitable structure or configuration capable of engaging the apparatus (20) to position or land the apparatus (20) in the primary and secondary wellbores (22, 24) in the manner described herein. In the preferred embodiment, when viewing the deflector (36) from its upper end (40) as shown in FIG. 3, the seat (48) is offset to one side opposite the deflecting surface (46).

Further, in the preferred embodiment, the primary wellbore deflector (36) further comprises a deflector conduit (50) associated with the seat (48). The deflector conduit (50) is associated with the seat (48), which engages the apparatus (20), in a manner such that the movement of fluids in the primary wellbore (22) through the deflector (36) and through the apparatus (20) is facilitated.

The deflector conduit (50) extends through the deflector (36) from the upper end (40) to the lower end (42). The deflector conduit (50) preferably includes an upper section (52), adjacent the upper end (40) of the conduit (36), communicating with a lower section (54), adjacent the lower end (42). Preferably, the seat (48) is associated with the upper section (52). Further, in the preferred embodiment, the seat (48) is comprised of all or a portion of the upper section (52) of the deflector conduit (50). In particular, the upper section (52) is shaped or configured to closely engage the apparatus (20) in the manner described below. The bore of the lower section (54) of the deflector conduit (50) preferably expands from the upper section (52) to the lower end (42) of the deflector (36). In other words, the cross-sectional area of the lower section (54) increases towards the lower end (42). Preferably, the increase in cross-sectional area is gradual, as shown in FIG. 2, and the cross-sectional area of the lower section (54) adjacent the lower end (42) is as close as practically possible to the cross-sectional area of the lower end (42) of the deflector (36), as shown in FIGS. 2 and 4.

Figure 6:
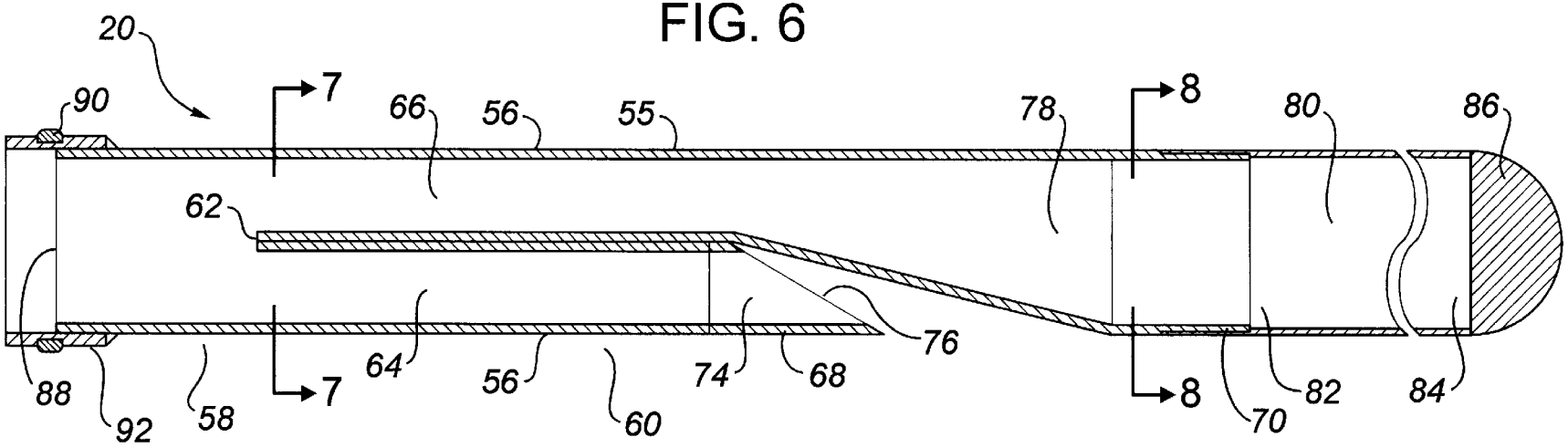
FIG. 6 is a longitudinal sectional view of a preferred embodiment of the apparatus of the within invention at rest in an undeformed state.
Figure 7:
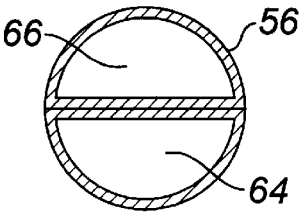

Referring to FIGS. 6 through 12, in the preferred embodiment, the apparatus (20) is comprised of a conduit (55) having an outside surface (56) as described below. Preferably, the conduit (55) is generally tubular or cylindrical in shape such that the conduit (55) is generally circular on cross-section, as shown in FIG. 7, and defines an outside diameter. However, any other shape or configuration of the conduit (55) may also be used. Where the outside surface (56) of the conduit (55) is other than generally circular in cross-section, the outside diameter of the conduit (55) is defined by the maximum cross-sectional dimension of the conduit (55).

The conduit (55) is comprised of an upper section (58), a lower section (60) and a deformable conduit junction (62). The conduit (55) may be integrally formed, in that the upper section (58), the lower section (60) and the deformable conduit junction (62) are comprised of a single piece or structure. Alternately, the conduit (55), and each of the upper section (58), the lower section (60) and the deformable conduit junction (62), may be formed by interconnecting or joining together two or more pieces or portions. In addition, the upper section (58) is connectable, either directly or indirectly, to other equipment. For instance, in particular, the upper section (58) is capable of attachment to a pipe string in order that the apparatus (20) may be inserted and lowered in the primary wellbore (22) by the pipe string. Specifically, the apparatus (20) is lowered in the primary wellbore (22) by conventional techniques. Preferably, the apparatus (20) is lowered using drill pipe, however, any other suitable pipe string may be used.

The lower section (60) is comprised of a primary leg (64) and a secondary leg (66). The primary leg (64) is capable of engaging the seat (48) of the primary wellbore deflector (36), while the secondary leg (66) is capable of being inserted into the secondary wellbore (24). The deformable conduit junction (62) is located between the upper section (58) and the lower section (60) of the conduit (55) comprising the apparatus (20), whereby the conduit (55), and in particular the lower section (60), is separated or divided into the primary and secondary legs (64, 66).

The primary leg (64) has a distal end (68) opposing the deformable conduit junction(62). Thus, the primary leg (64) extends from the conduit junction (62), in a direction away from the upper section (58) of the conduit (55), for a desired length to the distal end (68) of the primary leg (64). In the preferred embodiment, the primary leg (64) is tubular or hollow such that fluid may be conducted therethrough from the conduit junction (62) to the distal end (68). Thus, fluid may be conducted through the primary wellbore (22) by passing through the conduit (55) of the apparatus (20) and the deflector conduit (50) of the primary wellbore deflector (36). However, where conducting of the fluid through the primary leg (64) is either not required or not desired, the primary leg (64) need not be hollow. Rather, the primary leg (64) may form a solid leg for engaging the seat (48). Alternately, the primary leg (64) may include a valve, manually or remotely controllable, for controlling the flow of the fluid through the primary leg (64).

The secondary leg (66) also has a distal end (70) opposing the deformable junction (62). Thus, the secondary leg (66) extends from the conduit junction (62), in a direction away from the upper section (58) of the conduit (55), for a desired length to the distal end (70) of the secondary leg (66). The secondary leg (66) is tubular or hollow for conducting fluid therethrough from the conduit junction (62) to the distal end (70).

The primary leg (64) may be of any length permitting the primary leg (64) to engage the seat (48) of the deflector (36). The secondary leg (66) may be of any length permitting the secondary leg (66) to be deflected into the secondary wellbore (24). Further, the primary and secondary legs (64, 66) may be of any lengths relative to each other. However, in the preferred embodiment, the secondary leg (66) is longer than the primary leg (64) such that the distal end (70) of the secondary leg (66) extends beyond the distal end (68) of the primary leg (64) when the conduit junction (62) is undeformed. The reasons for this preference are dealt with below.

In the preferred embodiment, when the deformable conduit junction (62) is in an undeformed position, the primary leg (64) and the secondary leg (66) are substantially parallel to each other. Thus, the longitudinal axes defined by each of the primary and secondary legs (64, 66) are substantially parallel to each other. In addition, the conduit (55) preferably defines a longitudinal axis extending therethrough, through the upper and lower sections (52, 54). In order to facilitate the insertion and lowering of the conduit (55) in the primary wellbore (22), the longitudinal axes of the primary and secondary legs (64, 66) are preferably also substantially parallel to the longitudinal axis of the conduit (55). However, the primary and secondary legs (64, 66) need not be substantially parallel to each other, and the longitudinal axes of the primary and secondary legs (64, 66) need not be substantially parallel to the longitudinal axis of the conduit (55), as long as the conduit (55) may be inserted and lowered into the primary wellbore (22) when the conduit junction (62) is in a substantially undeformed position.

The conduit (55) may have any outside diameter, however, the maximum outside diameter must be less than the internal diameter of the primary wellbore (22) when the deformable junction is undeformed. In the preferred embodiment, the maximum outside diameter of the conduit (55) is slightly or marginally less than the internal diameter of the primary wellbore (22). As a result, the outside surface (56) of the conduit (55) will be adjacent or in close proximity to the internal surface (26) of the casing string (28) when the conduit (55) is being lowered in the primary wellbore (22).

Figure 12:
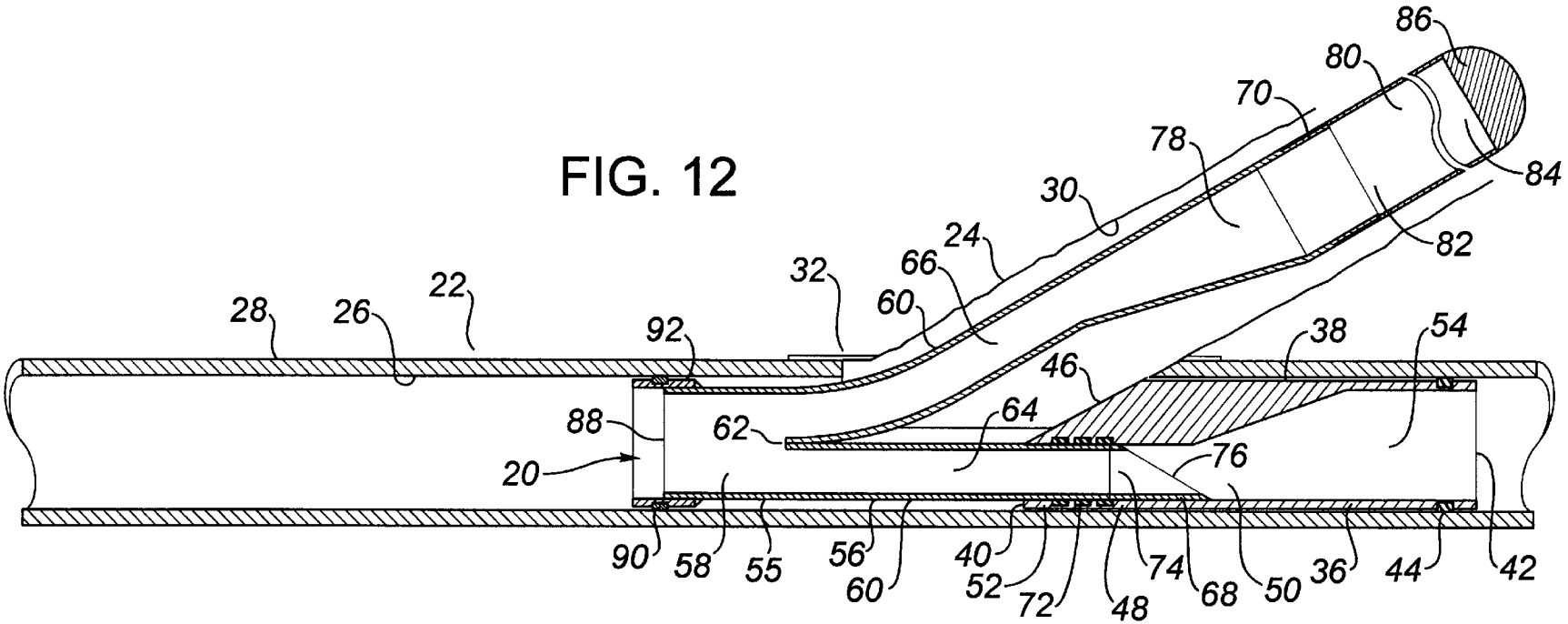
FIG. 12 is a longitudinal sectional view of the apparatus positioned at the junction between the primary and secondary wellbores, wherein the apparatus is in a deformed state such that a secondary leg of the apparatus is deflected into the secondary wellbore and the primary leg of the apparatus engages the primary wellbore deflector.

Further, the maximum outside diameter and the overall shape or configuration of the conduit (55) are selected or chosen such that when the apparatus (20) is connected to the pipe string and lowered in the primary wellbore (22), the secondary leg (66) is capable of being deflected into the secondary wellbore (24) by the primary wellbore deflector (36) such that the deformable conduit junction (62) becomes deformed and the primary leg (64) then engages the seat (48) of the primary wellbore deflector (36), as shown in FIG. 12.

The deformable conduit junction (62) separates the primary leg (64) and the secondary leg (66) and permits the placement of the apparatus (20) in the primary and secondary wellbores (22, 24). As described, the deformable conduit junction (62) may be either in an undeformed position, for lowering of the conduit (55) in the primary wellbore (22), or in a deformed position, upon deflection of the secondary leg (66) and seating of the primary leg (64). Preferably, the deformable conduit junction (62) is biased towards the undeformed position. Thus, a force must be applied for the conduit junction (62) to move towards the deformed position. However, alternately, the deformable conduit junction (62) may be biased towards the deformed position. In this case, a force would need to be applied to move the conduit junction (62) towards the undeformed position.

To maximize the cross-sectional area of the lower section (60) of the conduit (55), each of the primary and secondary legs (64, 66) preferably forms a portion or a section of the lower section (60). In other words, on cross-section, each of the primary and secondary legs (64, 66) forms a portion or sector of a full circle. In the preferred embodiment, each of the primary and secondary legs (64, 66) forms one half of the lower section (60), such that, on cross-section, each of the primary and secondary legs (64, 66) forms a semi-circle, as shown in FIG. 7. Further, as stated, the outside diameter of the conduit (55) approximates, or is slightly or marginally less than, the internal diameter of the primary wellbore (22). Thus, the outside surface (56) of the conduit (55) is adjacent or in close proximity to the internal surface (26) of the primary wellbore (22) and the combined cross-sectional areas of the primary and secondary legs (64, 66) approximates, or is slightly or marginally less than, the cross-sectional area of the primary wellbore (22).

However, although this configuration is preferred, the primary and secondary legs (64, 66) may have any shape as long as the maximum outside diameter of the conduit (55) is less than the internal diameter of the primary wellbore (22) and the secondary leg (66) is capable of being deflected into the secondary wellbore (24) while the primary leg (64) engages the seat (48) of the primary wellbore deflector (36). For example, each of the primary and secondary legs (64, 66) may be circular on cross-section.

As stated, the primary leg (64) is capable of engagement with the seat (48) of the primary wellbore deflector (36). Thus, the shape and configuration of the primary leg (64) is chosen or selected to be compatible with the seat (48), being the upper section (52) of the deflector conduit (50) in the preferred embodiment. In the preferred embodiment, the deflector conduit (50) is shaped to form a semi-circle on cross-section which is sized to accept or receive the primary leg (64) therein.

Further, the seat (48) engages the primary leg (64) such that the movement of fluid in the primary wellbore (22), through the primary wellbore deflector (36) and the conduit (55), is facilitated. Preferably, the primary leg (64) engages the seat (48) to provide a sealed connection between the deflector (36) and the primary wellbore (22). Any conventional seal assembly (72) may be used to provide this sealed connection. For instance, the seal assembly (72) may be comprised of one or a combination of seals or a friction fit between the adjacent surfaces. In the preferred embodiment, the seal assembly (72) is located between the primary leg (64) and the upper section (52) of the deflector conduit (50) when the primary leg (64) is seated or engages the seat (48). The seal assembly (72) may be associated with either the primary leg (64) or the upper section (52) of the deflector conduit (50). However, preferably, the seal assembly (72) is associated with the upper section (52) of the deflector conduit (50).

Further, the primary leg (64) preferably comprises a guide (74) for guiding the primary leg (64) into engagement with the seat (48). The guide (74) may be positioned at any location along the length of the primary leg (64) which permits the guide (74) to perform its function. However, preferably, the guide (74) is located at, adjacent or in proximity to the distal end (68) of the primary leg (64). The guide (74) may be of any shape or configuration capable of guiding the primary leg (64). However, preferably the guide (74) provides an inclined plane (76) facing towards the secondary leg (66), as shown in FIG. 6.

Figure 8:
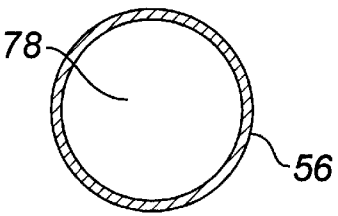
FIGS. 7 and 8 are cross-sectional views of the apparatus taken along lines 7—7 and 8—8 respectively of FIG. 6.

The secondary leg (66) comprises an expansion section (78) located at, adjacent or in proximity to the distal end (70) of the secondary leg (66). The expansion section (78) comprises a cross-sectional expansion of the secondary leg (66) in order to increase its cross-sectional area. As indicated above, the length of the secondary leg (66) is greater than the length of the primary leg (64) in the preferred embodiment. Preferably, the secondary leg (66) commences its cross-sectional expansion to form the expansion section (78) at a distance from the conduit junction (62) approximately equal to or greater than the distance of the distal end (68) of the primary leg (64) from the conduit junction (62). Thus, when the conduit junction (62) is undeformed, the expansion section (78) is located beyond or distal to the distal end (68) of the primary leg (64) as shown in FIG. 6. Further, the expansion section (78) may have any size, shape and configuration permitting it to be lowered in the primary wellbore (22) when the conduit junction (62) is undeformed and permitting it to be deflected into the secondary wellbore (24) upon deformation of the conduit junction (62). However, preferably, the expansion section (78) gradually expands such that it is substantially tubular or cylindrical at the distal end (70) of the secondary leg (66). Thus, at the distal end (70), the expansion section (78) is circular in cross-section, as shown in FIG. 8.

The outside surface of the expansion section (78) defines an outside diameter of the expansion section (78). Where the expansion section (78) is not cylindrical, the outside diameter of the expansion section (78) is defined by the maximum cross-sectional dimension of the expansion section (78). The maximum outside diameter of the expansion section (78) is less than the internal diameter of the primary wellbore, such that the conduit (55), including the expansion section (78), may be lowered in the primary wellbore (22) when the conduit junction is undeformed. As well, the maximum outside diameter of the expansion section (78) is less than the internal diameter of the secondary wellbore (24), such that the expansion section (78) may be deflected into the secondary wellbore (24) upon deformation of the conduit junction (62).

In the preferred embodiment, the cross-sectional area of the primary leg (64) and the secondary leg, other than the expansion section (78), are about equal. The expansion section (78) preferably provides an increased cross-sectional area of the secondary leg (66). Preferably, the increase in cross-sectional area is gradual, increasing towards the distal end (70), as shown in FIG. 6.

In the preferred embodiment, the apparatus (20) is further comprised of a liner (80) for lining the secondary wellbore (24). The liner (80) may be any conventional liner, including a perforated liner, a slotted liner or a prepacked liner. The liner includes a proximal end (82) and a distal end (84). The proximal end (82) is capable of being connected or attached to the secondary leg (66) by any conventional technique, device or method, such as by a threaded connection or welding. In the preferred embodiment, the proximal end (82) is attached to the distal end (70) of the secondary leg (66).

The distal end (84) extends into the secondary wellbore (24) such that all or a portion of the secondary wellbore (24) is lined by the liner (80). Thus, the apparatus (20) acts to hang the liner (80) in the secondary wellbore (24). The distal end (84) of the liner (80) may be sealed in any conventional manner. For instance, in the preferred embodiment, a conventional cap (86), such as a bullnose, is attached to the distal end (84) such that the distal end (84) of the liner (80) is sealed. In addition to sealing the distal end (84) of the liner (80), the cap (86) also facilitates the guiding of the liner (80) through the primary and secondary wellbores ((22, 24). More particularly, the cap (86) facilitates the deflection of the liner (80) into the secondary wellbore (24) by the primary wellbore deflector (36). The cap (86) may be attached or connected by any conventional technique, device or method, such as by a threaded connection or welding.

As stated, the upper section (58) of the conduit (55) is connectable, either indirectly or indirectly, to other equipment. In particular, the upper section (58) is capable of attachment either directly or indirectly to a pipe string in order that the apparatus (20) may be inserted and lowered in the primary wellbore (22) by the pipe string. The upper section (58) is comprised of a proximal end (88) opposing the deformable wellbore junction (62). Thus, the upper section (58) extends from the deformable junction (62), in a direction away from the lower section (60), for a desired length to the proximal end (88). The length of the upper section (58) may be any desired length permitting the upper section (58) to be attached to the pipe string either directly or indirectly. The pipe string may be directly or indirectly connected or attached to the upper section (58) in any conventional manner and by any conventional device or technique. However, in the preferred embodiment, the pipe string is attached to, at or immediately adjacent the proximal end (88) of the upper section (58). The attachment is by conventional means, such as by a threaded connection or welding.

The upper section (58) conducts fluid therethrough from the deformable conduit junction (62) to the proximal end (88). In the preferred embodiment, the upper section (58) permits the mixing or co-mingling of any fluids passing from the primary and secondary legs (64, 66) into the upper section (58). However, alternately, the upper section (58) may continue the segregation of the fluids from the primary and secondary legs (64, 66) through the upper section (58). Thus, the fluids are not permitted to mix or co-mingle in the upper section (58).

Further, the upper section (58) may be associated with or comprised of one or more deflectors (not shown) for facilitating the deflection of equipment passing through the upper section (58) into either the primary or secondary legs (64, 66). The deflector is preferably contained within the bore of the upper section (58) of the conduit (55). The deflector may or may not reduce the bore or internal diameter of the upper section (58) of the conduit (58).

In the preferred embodiment, the apparatus (20) is further comprised of a seal assembly (90). The seal assembly (90) is associated with the upper section (58) of the conduit (55), or may form or comprise a portion thereof, such that the seal assembly (90) provides a seal between the conduit (55) and the primary wellbore (22). Preferably, the seal assembly (90) is located between the outside surface (56) of the upper section (58) of the conduit (55) and the internal surface (26) of the primary wellbore (22). Further, the seal assembly is preferably located at, adjacent or in proximity to the proximal end (88) of the upper section (58). Thus, wellbore fluids are inhibited from passing between the conduit (55) and the casing string (28) by the seal assembly (90). The seal assembly (90) may be comprised of any conventional seal or sealing structure. For instance, the seal assembly (90) may be comprised of one or a combination of seals, packers, slips, liners or cementing.

In the preferred embodiment, the conduit (55) and the conduit junction (62) are hydraulically sealed upon the placement or positioning of the conduit (55) in the primary and secondary wellbores (22, 24) when the primary leg (64) is landed in the seat (48), as shown in FIG. 12 and as described herein. Specifically, wellbore fluids in the primary wellbore are inhibited from passing through the primary wellbore (22) other than through the conduit (55). As well, wellbore fluids cannot pass between the primary and secondary wellbores (22, 24) except through the conduit (55). Finally, the fluid cannot enter or exit the conduit (55) except through the proximal end (88) of the upper section (58) and the distal ends (68, 70) of the primary and secondary legs (64, 66) of the conduit (55).

The hydraulic sealing, as described, may be accomplished by any conventional seal assembly or any combination of conventional seal assemblies associated with the conduit (55) at any effective locations such that the sealing is achievable. However, in the preferred embodiment, the hydraulic sealing is accomplished by the combination of the seal assembly (44) between the primary wellbore deflector (36) and the internal surface (26) of the primary wellbore (22), the seal assembly (90) between the upper section (58) of the conduit (55) and the internal surface (26) of the primary wellbore (22) and the seal assembly (72) between the primary leg (64) and the seat (48), being the upper section (52) of the deflector conduit (50).

In addition, once the apparatus (20) is landed in position in the primary and secondary wellbores (22, 24) such that the primary leg (64) engages the seat (48), the apparatus (20) is preferably mechanically tied back to the primary wellbore (22), and in particular the casing string (28) in the preferred embodiment, in order to support the apparatus (20) in the wellbores (22, 24) and inhibit its movement. The apparatus (20) may be permanently tied back or anchored in the primary wellbore (22), such as by cementing the apparatus (20) in place within the primary and secondary wellbores (22, 24). However, preferably, the apparatus (20) is removably tied back or anchored to the primary wellbore (22) such that it may be removed when no longer desired or required. In particular, the conduit (55) is preferably removably tied back or anchored to the primary wellbore (22). The mechanical tying or anchoring of the apparatus (20) may be accomplished by any conventional device, technique or method. However, preferably, the apparatus (20) is further comprised of an anchor assembly (92) associated with the conduit (55) such that the apparatus (20) is supported in the wellbores (22, 24).

In the preferred embodiment, the anchor assembly (92) is associated with the upper section (58) of the conduit (55) and may form or comprise a portion thereof. However, it may be located at any other suitable location for anchoring the apparatus (20). More preferably, the anchor assembly (92) is located between the outside surface (56) of the upper section (58) of the conduit (55) and the internal surface (26) of the primary wellbore (22), or the casing string (28) in the preferred embodiment. Further, the anchor assembly (92) is preferably located at, adjacent or in proximity to the proximal end (88) of the upper section (58). Thus, the apparatus (20) is supported by the upper section (58) of the conduit (55). The anchor assembly (92) may be comprised of any conventional anchor or anchoring structure, such as a conventional packer, latch assembly or liner hanger.

Figure 9:
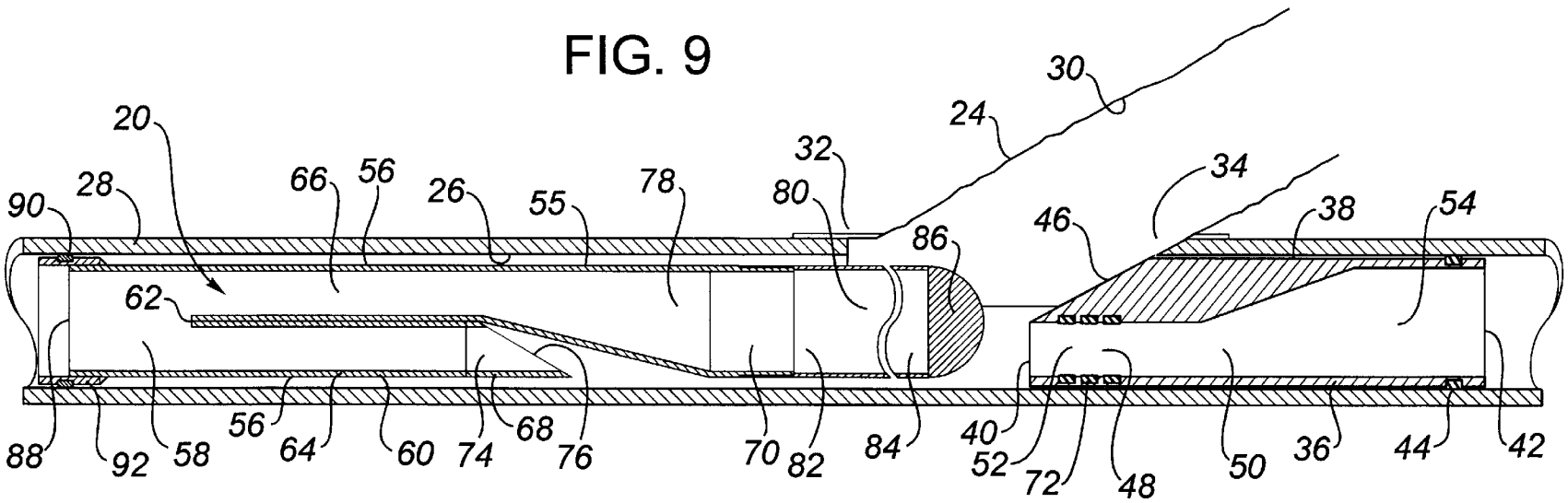
FIG. 9 is a longitudinal sectional view of the apparatus in an undeformed state being placed within the casing string of the primary wellbore, wherein the primary wellbore deflector is set in position in the primary wellbore, as shown in FIG. 5.
Figures 10, 11:
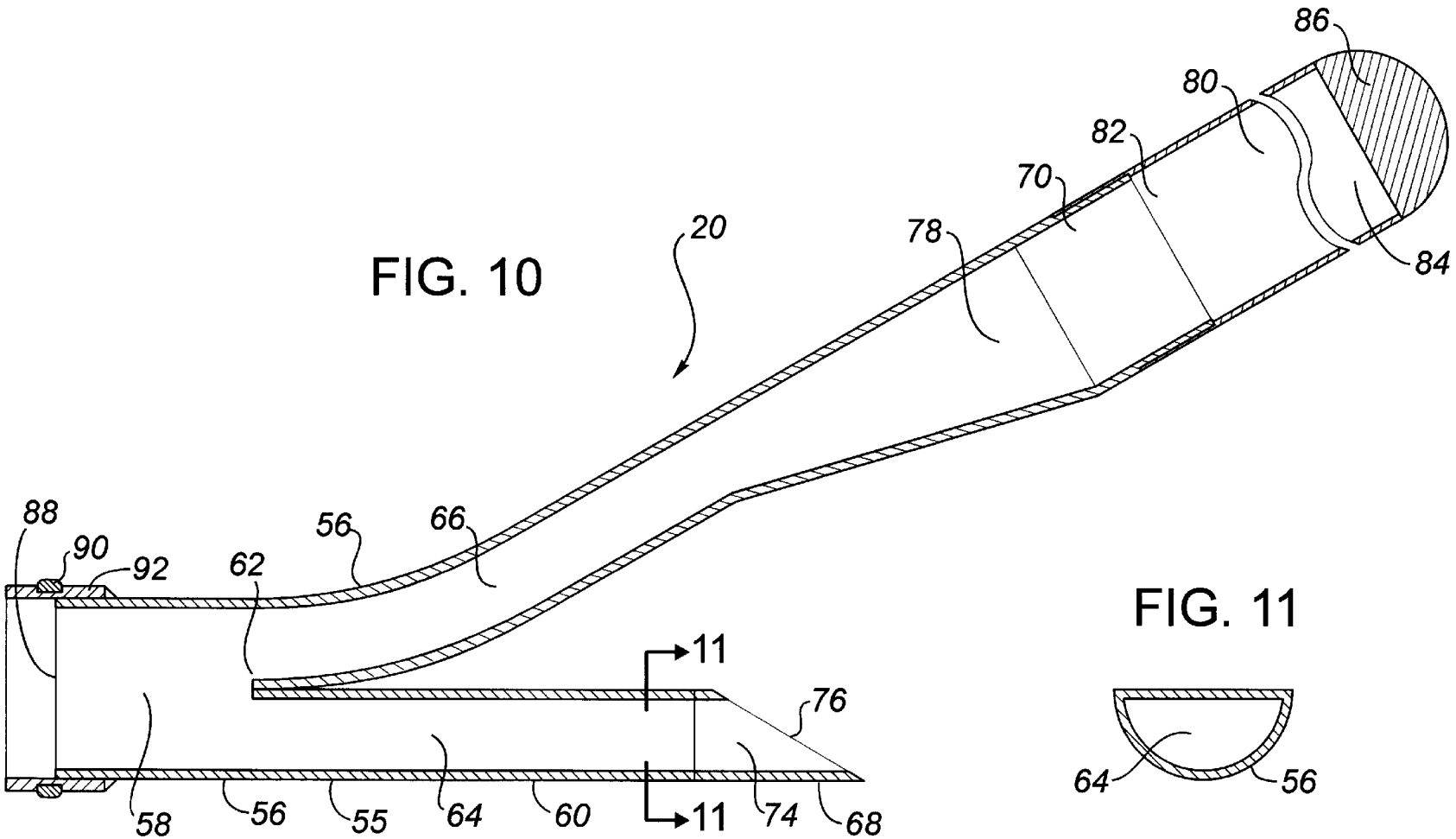
FIG. 10 is a longitudinal sectional view of the apparatus in a deformed state.
FIG. 11 is a cross-sectional view of an expansion section of the apparatus taken along line 11—11 of FIG. 10.

The deformable conduit junction (62) may be comprised of any deformable material, and may be constructed in any matter permitting deformation, such that the conduit junction (62) may be in either a deformed or undeformed position, as shown in FIGS. 10 and 6 respectively. As stated, in the preferred embodiment, the conduit junction (62) is preferably biased towards the undeformed position. When inserting and lowering the conduit (55) in the primary wellbore (22), the conduit junction (62) is thus at rest in the undeformed position, as shown in FIGS. 6 and 9. However, upon landing of the conduit (55) such that the secondary leg (66) is deflected in the secondary wellbore (24), the conduit junction (62) is deformed to the deformed position to permit the deflection, as shown in FIGS. 10 and 12. The conduit junction (62) deforms to permit the deflection of the secondary leg (66) into the secondary wellbore (24). In addition, the deformation will also permit the primary leg (64) to be deflected, where required, in order that it may engage the seat (48).

However, as stated, the deformable conduit junction (62) may be biased towards the deformed position, as shown in FIG. 10, such that the conduit junction (62) is at rest in the deformed position. Thus, in order to insert and lower the conduit (55) in the primary wellbore (22), the conduit junction (62) must undergo an amount of deformation to move from the deformed position towards the undeformed position, as shown in FIGS. 6 and 9. Upon landing of the conduit (55) such that the secondary leg (66) is deflected in the secondary wellbore (24), the conduit junction (62) is then permitted to move back towards the deformed position, as shown in FIGS. 10 and 12, such that the conduit junction (62) is preferably substantially at rest.

Any material capable of deformation in the described manner may be used, such as a deformable metal, rubber or plastic. However, in the preferred embodiment, the deformable material is comprised of a semi-rigid material, as described further below. Further, the deformable material may be either plastically or elastically deformable. However, preferably, the material comprising the conduit junction (62) is selected or chosen such that the conduit junction (62) undergoes elastic deformation upon the deflection of the secondary leg (66).

In order to ensure that the conduit junction (62) deforms elastically only, the angle of the intersection between the primary and secondary wellbores (22, 24) is selected or chosen in conjunction with the material such that the required degree of the deflection of the secondary leg (66) is within the elastic deformation range of the selected material. Elastic deformation is preferred as deformation within the elastic range of the material is less likely to stress the material to breaking or failure. In addition, elastic deformation will facilitate the removal of the apparatus (20) from the wellbores (22, 24), if desired.

The deformable conduit junction (62) may have any shape or configuration, and may connect the upper and lower sections (58, 60) of the conduit (55) in any manner, which permits fluids to pass through the conduit (55) and which separates the lower section (60) into the primary and secondary legs (64, 66). However, the outside diameter of the conduit junction (62) must be less than or equal to the maximum outside diameter of the conduit (55), as defined above, when the conduit junction (62) is undeformed. In the preferred embodiment, the deformable conduit junction (62) is comprised of a welded connection between the primary leg (64) and the secondary leg (66).

The primary and secondary legs (64, 66) are also each comprised of a semi-rigid material. A semi-rigid material is defined as a material which will permit an amount of strain, while substantially maintaining the shape of the structure formed by the semi-rigid material. In the preferred embodiment, the semi-rigid material will substantially maintain the cross-sectional dimensions of the specific structure formed by the semi-rigid material, while permitting the required degree of strain.

Upon the lowering of the conduit (55) in the primary wellbore (22). the primary and secondary legs (64, 66) are preferably at rest or in an undeformed position. However, it is understood and expected that upon the landing of the conduit (55) and the deformation of the conduit junction (62), all or a portion of the primary and secondary legs (64, 66) may also undergo an amount of stretch, bend, deformation or strain in order to further facilitate the entry of the primary and secondary legs (64, 66) into the seat (48) and the secondary wellbore (24) respectively. Preferably, the amount of strain is just sufficient to facilitate the entry of the primary and secondary legs (64, 66) into the seat (48) and the secondary wellbore (24) respectively, and no more.

Alternately, as discussed above, where the deformable conduit junction (62) is biased towards the deformed position, it is understood and expected that all or a portion of the primary and secondary legs (64, 66) may similarly undergo an amount of stretch, bend, deformation or strain in order to facilitate the insertion and lowering of the conduit (55) in the primary wellbore (22). Again, preferably, the amount of strain is just sufficient to permit and facilitate the insertion and lowering of the conduit (55) in the primary wellbore (22), and no more.

Each of the legs (64, 66) tends to strain immediately adjacent to the point of connection to the deformable conduit junction (62) and for a distance from the conduit junction (62), however, the entire length of the legs (64, 66) may require an amount of strain. Given the deformation of the conduit junction (62) and the possible strain of the primary and secondary legs (64, 66), the specific demarcation between the conduit junction (62) and the primary and secondary legs (64, 66) may be not be exact or clearly definable when both elements are comprised of a similar material, such as a semi-rigid material.

Depending upon the amount of strain that may occur in the primary and secondary legs (64, 66), and in particular in the secondary leg (66), the cross-sectional dimensions of the legs (64, 66) may be affected. However, in the preferred embodiment, the conduit (55) is designed in accordance with the angle of intersection between the primary and secondary wellbores (64, 66) such that the amount of strain is minimal or insubstantial. Thus, the secondary leg (66) will comprise substantially the same cross-sectional dimension when the deformable conduit junction (62) is both undeformed and deformed. Similarly, the primary leg (64) will also comprise substantially the same cross-sectional dimension when the deformable conduit junction (62) is both undeformed and deformed.

Any semi-rigid material may be used. Thus, the semi-rigid material comprising the primary and secondary legs (64, 66) may permit either plastic or elastic deformation. However, in the preferred embodiment, the semi-rigid material is selected or chosen such that the legs (64, 66), and in particular, the secondary leg (66) may undergo elastic deformation upon the positioning and landing of the apparatus (20) in the wellbores (22, 24).

Although preferred, the guide (74) of the primary leg (64) and the expansion section (78) of the secondary leg (66) need not be comprised of a semi-rigid material, but may be comprised of any other suitable material, such as a rigid or plastically deformable material. Similarly, the upper section (58) of the conduit (55) may be comprised of any suitable material, such as a rigid or semi-rigid material. In the preferred embodiment, the entire conduit (55) is comprised of a standard steel alloy.

The within invention is also comprised of a method for completing the wellbores (22, 24), and more particularly, for completing the wellbore junction (32). In the preferred embodiment, the method is particularly directed at a method for hanging a liner (80) in the secondary wellbore (24). The liner (80) may be any conventional liner as described above. Further, the primary and secondary wellbores (22, 24) and the wellbore junction (32) are as described above. As well, the method may be performed using any suitable device or apparatus capable of being used to perform the method steps. However, preferably, the method is performed using the preferred embodiment of the apparatus (20) of the within invention, as described above.

The method comprises the following steps, which are preferably performed in the sequence set forth. First, the primary wellbore deflector (36) is installed in the primary wellbore (22) adjacent to the wellbore junction (32), as previously described. The primary wellbore deflector (36) may be installed using any conventional equipment, techniques or methods.

Second, the liner (80) is inserted into the wellbore, and particularly the primary wellbore (22), and lowered therein. The liner (80) is preferably attached to the secondary leg (66) of the conduit (55). In the preferred embodiment, the proximal end (82) of the liner (80) is attached to the distal end (70) of the secondary leg (66). As described above, the conduit (55), with the attached liner (80), may be inserted and lowered in the primary wellbore (22) using any conventional equipment, techniques or methods. However, preferably the conduit (55) is lowered in the primary wellbore (22) by a pipe string connected to the proximal end (88) of the upper section (58) of the conduit (55). Although any suitable pipe string may be used, the conduit (55) is preferably lowered by the drill pipe. Further, in the preferred embodiment, the conduit (55), including the conduit junction (62) and the primary and secondary legs (64, 66) are undeformed while lowering the liner (80).

As the liner (80) is lowered in the primary wellbore (22), it is deflected into the secondary wellbore (24) at the wellbore junction (32) by the primary wellbore deflector (36). Where necessary, prior to the step of deflecting the liner (80) into the secondary wellbore (24), the liner (80) may need to be oriented for proper entry into the secondary wellbore (24). In particular, the liner (80) may need to be oriented relative to the deflecting surface (46) of the primary wellbore deflector (36) such that contact with the deflecting surface (46) deflects the liner (80) into the adjacent secondary wellbore (24). Any conventional orienting techniques or equipment may be used, such as an orienting latch assembly.

As well, where necessary, following the insertion of the liner (80) into the secondary wellbore (24), the conduit (55) may need to be further oriented for proper landing of the liner (80) into position. In particular, the conduit (55) may need to be oriented relative to the deflecting surface (46) of the primary wellbore deflector (36) such that the secondary leg (66) of the conduit (55) is deflected into the secondary wellbore (24) and the primary leg (64) of the conduit (55) engages the seat (48) of the primary wellbore deflector (36). Preferably, the conduit (55) is oriented in this manner just prior to the landing step and prior to the deformation of the deformable conduit junction (62). Again, any conventional orienting techniques or equipment may be used, such as an orienting latch assembly.

The liner (80) is then landed into position by continuing to lower the liner (80) into the wellbore. At this time, the liner (80) may require further lowering in the secondary wellbore (24) alone or in both the primary and secondary wellbores (22, 24) depending upon the specific dimensions of the liner (80) and the conduit (55). Regardless, the liner (80) is landed by continuing to lower the liner (80) so that the secondary leg (66) of the conduit (55) is deflected into the secondary wellbore (24) by the primary wellbore deflector (36), the deformable conduit junction (62) is deformed and the primary leg (64) of the conduit (55) engages the seat (48) of the primary wellbore deflector (36).

Only upon landing of the liner (80) does the conduit (55), and in particular the conduit junction (62), undergo deformation to permit the secondary leg (66) to be deflected into the secondary wellbore (24). In addition, at least the secondary leg (66) may require an amount of bending sufficient to permit the secondary leg (66) to enter the secondary wellbore (24).

The liner (80) is preferably anchored in the landed position to the primary wellbore (22). The liner (80) may be anchored to the primary wellbore (22) using any conventional anchoring equipment, techniques or methods. However, in the preferred embodiment, the anchoring step comprises actuating the anchor assembly described above.

Where the wellbore is comprised of greater than one secondary wellbore (24), such that there is greater than one wellbore junction (32), a liner (80) may be hung in each secondary wellbore (24) in sequence. In particular, each wellbore junction (32) is completed in sequence or in succession commencing with the secondary wellbore (24) farthest from the surface and working towards the secondary wellbore (24) nearest to the surface.

Finally, the method may further comprise the step of removing the apparatus (20) from the primary and secondary wellbores (22, 24). In particular, one or all of the conduit (55), the liner (80) and the primary wellbore deflector (36) may be removed as required or desired for any particular use or application of the primary and secondary wellbores (22, 24). Any conventional apparatus or techniques may be used to remove the desired elements of the apparatus (20), such as retrieving the anchor assembly (92).

The embodiments of the invention in which an exclusive property or privilege is claimed are defined as follows:

1. An apparatus for insertion in a wellbore for the purpose of completing a well, the wellbore being of the type comprising a primary wellbore, a secondary wellbore intersecting the primary wellbore, a wellbore junction at the location of the intersection between the primary wellbore and the secondary wellbore, and a primary wellbore deflector located in the primary wellbore adjacent to the wellbore junction such that equipment inserted in the primary wellbore can be deflected into the secondary wellbore at the wellbore junction, the primary wellbore deflector comprising a seat for engagement with the apparatus, the apparatus comprising a conduit comprising the following:

(a) an upper section for attachment to a pipe string;

(b) a lower section comprising a primary leg for engaging the seat of the primary wellbore deflector and a secondary leg for insertion in the secondary wellbore; and (c) a deformable conduit junction located between the upper section and the lower section of the conduit whereby the conduit is separated into the primary leg and the secondary leg;

such that when the apparatus is connected to the pipe string and lowered in the primary wellbore, the secondary leg is deflected into the secondary wellbore by the primary wellbore deflector such that the deformable conduit junction becomes deformed, and the primary leg then engages the seat of the primary wellbore deflector.

2. The apparatus as claimed in claim 1, wherein the primary leg comprises a guide for guiding the primary leg into engagement with the seat of the primary wellbore deflector.

3. The apparatus as claimed in claim 2, wherein the primary leg has a distal end opposing the deformable conduit junction and wherein the guide is located at the distal end.

4. The apparatus as claimed in claim 3, wherein the primary wellbore deflector further comprises a deflector conduit associated with the seat and wherein the primary leg is capable of engaging the seat to facilitate the movement of fluids in the primary wellbore through the primary wellbore deflector and through the conduit.

5. The apparatus as claimed in claim 4, wherein the primary leg engages the seat to provide a sealed connection between the deflector conduit and the primary leg.

6. The apparatus as claimed in claim 5, wherein the secondary leg has a distal end opposing the deformable conduit junction and wherein the secondary leg comprises an expansion section located at the distal end.

7. The apparatus as claimed in claim 6 wherein the secondary wellbore has an internal diameter and wherein the expansion section has a maximum outside diameter which is less than the internal diameter of the secondary wellbore.

8. The apparatus as claimed in claim 7, further comprising a liner having a proximal end attached to the secondary leg of the conduit and a distal end, for lining the secondary wellbore.

9. The apparatus as claimed in claim 8, further comprising a cap attached to the distal end of the liner, for sealing and guiding the distal end of the liner.

10. The apparatus as claimed in claim 5, further comprising the primary wellbore deflector.

11. The apparatus as claimed in claim 10 wherein the apparatus is removable from the wellbore.

12. The apparatus as claimed in claim 1 wherein the primary wellbore has an internal diameter and wherein the conduit has a maximum outside diameter which is less than the internal diameter of the primary wellbore when the deformable conduit junction is undeformed.

13. The apparatus as claimed in claim 1 wherein the apparatus is removable from the wellbore.

14. A method for hanging a liner in a wellbore, the wellbore being of the type comprising a primary wellbore, a secondary wellbore intersecting the primary wellbore, a wellbore junction at the location of the intersection between the primary wellbore and the secondary wellbore, and a primary wellbore deflector located in the primary wellbore adjacent to the wellbore junction such that when the liner is inserted in the primary wellbore it can be deflected into the secondary wellbore at the wellbore junction, the primary wellbore deflector comprising a seat, the method comprising the following steps in the sequence set forth;

(a) installing the primary wellbore deflector in the primary wellbore adjacent to the wellbore junction;

(b) lowering the liner into the wellbore, wherein the liner is attached to a secondary leg of a conduit which further comprises a primary leg for engagement with the seat of the primary wellbore deflector and a deformable conduit junction connecting the primary leg and the secondary leg;

(c) deflecting the liner into the secondary wellbore by the primary wellbore deflector;

(d) landing the liner into position by continuing to lower the liner into the wellbore so that the secondary leg of the conduit is deflected into the secondary wellbore by the primary wellbore deflector, the deformable conduit junction is deformed and the primary leg of the conduit engages the seat of the primary wellbore deflector.

15. The method as claimed in claim 14, further comprising the step, following the landing step, of anchoring the liner in its landed position to the primary wellbore.

16. The method as claimed in claim 15, wherein the anchoring step comprises actuating an anchor assembly connected to the conduit.

17. The method as claimed in claim 14, further comprising the step, following the lowering step, of orienting the liner for entry into the secondary wellbore.

18. The method as claimed in claim 14, further comprising the step, prior to the landing step, of orienting the conduit relative to the primary wellbore deflector such that the secondary leg is deflected into the secondary wellbore by the primary wellbore deflector and the primary leg engages the seat of the primary wellbore deflector.

19. The method as claimed in claim 14, further comprising the step of removing the conduit from the primary and secondary wellbores.

20. The method as claimed in claim 19, further comprising the step of removing the primary wellbore deflector from the primary wellbore.

21. An apparatus for insertion in a wellbore for the purpose of completing a well, the wellbore being of the type comprising a primary wellbore, a secondary wellbore intersecting the primary wellbore, a wellbore junction at the location of the intersection between the primary wellbore and the secondary wellbore, and a primary wellbore deflector located in the primary wellbore adjacent to the wellbore junction such that equipment inserted in the primary wellbore can be deflected into the secondary wellbore at the wellbore junction, the primary wellbore deflector comprising a seat for engagement with the apparatus, the apparatus comprising a conduit comprising the following:

(a) an upper section for attachment to a pipe string;

(b) a lower section comprising a primary leg for engaging the seat of the primary wellbore deflector and a secondary leg for insertion in the secondary wellbore;

(c) a deformable conduit junction located between the upper section and the lower section of the conduit whereby the conduit is separated into the primary leg and the secondary leg; and (d) an anchor assembly associated with the upper section of the conduit for supporting the apparatus in the wellbore;

such that when the apparatus is connected to the pipe string and lowered in the primary wellbore the secondary leg is deflected into the secondary wellbore by the primary wellbore deflector such that the deformable conduit junction becomes deformed, and the primary leg then engages the seat of the primary wellbore deflector.

22. The apparatus as claimed in claim 21, further comprising a seal assembly associated with the upper section of the conduit, for providing a seal between the conduit and the primary wellbore.

23. An apparatus for insertion in a wellbore for the purpose of completing a well, the wellbore being of the type comprising a primary wellbore, a secondary wellbore intersecting the primary wellbore, a wellbore junction at the location of the intersection between the primary wellbore and the secondary wellbore, and a primary wellbore deflector located in the primary wellbore adjacent to the wellbore junction such that equipment inserted in the primary wellbore can be deflected into the secondary wellbore at the wellbore junction, the primary wellbore deflector comprising a seat for engagement with the apparatus, the apparatus comprising a conduit comprising the following:

(a) an upper section for attachment to a pipe string;

(b) a lower section comprising a primary leg for engaging the seat of the primary wellbore deflector and a secondary leg for insertion in the secondary wellbore; and (c) a deformable conduit junction located between the upper section and the lower section of the conduit whereby the conduit is separated into the primary leg and the secondary leg;

such that when the apparatus is connected to the pipe string and lowered in the primary wellbore, the secondary leg is deflected into the secondary wellbore by the primary wellbore deflector such that the deformable conduit junction becomes deformed and the primary leg then engages the seat of the primary wellbore deflector, wherein the upper section comprises a proximal end opposing the deformable conduit junction, wherein the primary leg comprises a distal end opposing the deformable conduit junction, wherein the secondary leg comprises a distal end opposing the deformable conduit junction, and wherein a fluid cannot enter or exit the conduit except through the proximal end of the upper section of the conduit and the distal ends of the primary and secondary legs of the conduit.

24. The apparatus as claimed in claim 23, wherein the primary leg and the secondary leg are substantially parallel to each other when the deformable conduit junction is undeformed.

25. The apparatus as claimed in claim 24, wherein the secondary leg is comprised of a semi-rigid material such that it comprises substantially the same cross-sectional dimension when the deformable conduit junction is both undeformed and deformed.

26. The apparatus as claimed in claim 25, wherein the primary leg is comprised of a semi-rigid material such that it comprises substantially the same cross-sectional dimension when the deformable conduit junction is both undeformed and deformed.

27. The apparatus as claimed in claim 26, wherein the deformable conduit junction comprises a welded connection between the primary leg and the secondary leg.

28. The apparatus as claimed in claim 27, wherein the conduit is comprised of a steel alloy.

* * * * *